US005855240A

United States Patent [19]

Farrell et al.

[11] Patent Number: 5,855,240

[45] Date of Patent: Jan. 5, 1999

[54] AUTOMOTIVE HEAT EXCHANGER

[75] Inventors: Paul Arthur Farrell, Ann Arbor; Carl Eckardt Schornhorst, Canton, both of Mich.; Kevin Bennett Wise, Connersville, Ind.

[73] Assignee: Ford Motor Company, Dearborn, Mich.

[21] Appl. No.: 89,681

[22] Filed: Jun. 3, 1998

[51] Int. Cl.[6] ..... F28D 1/03

[52] U.S. Cl. ..... 165/76; 165/152; 165/DIG. 464

[58] Field of Search ..... 165/76, 153, DIG. 464, 165/152; 29/890.039, 890.03; 72/379.2

[56] References Cited

U.S. PATENT DOCUMENTS

| | | |
|---|---|---|
| 1,941,892 | 1/1934 | Greve . |
| 2,490,976 | 12/1949 | Mayne et al. . |
| 2,560,786 | 7/1951 | Wright et al. . |
| 2,728,982 | 1/1956 | Merrill . |
| 3,258,832 | 7/1966 | Gerstung . |
| 3,292,690 | 12/1966 | Donaldson . |
| 3,341,925 | 9/1967 | Gerstung . |
| 3,425,113 | 2/1969 | Ward, Jr. . |
| 3,762,031 | 10/1973 | Jonason et al. . |
| 4,434,643 | 3/1984 | Almqvist et al. . |
| 4,562,630 | 1/1986 | Larsson . |
| 4,628,661 | 12/1986 | St. Louis . |
| 4,679,410 | 7/1987 | Drayer . |
| 5,507,338 | 4/1996 | Schornhorst et al. . |

FOREIGN PATENT DOCUMENTS

| | | |
|---|---|---|
| 61-217697 | 9/1986 | Japan . |
| 62-203632 | 9/1987 | Japan . |
| 63-278621 | 11/1988 | Japan . |

*Primary Examiner*—Allen Flanigan
*Attorney, Agent, or Firm*—Raymond L. Coppiellie

[57] ABSTRACT

A heat exchanger formed from a plurality of adjacent, contiguous plate members is disclosed. The plate members are joined together by a first and second set of tabs, the tabs being configured to bend at predefined locations. The plates are folded in a bellows-like fashion to form a heat exchanger core. The bend zones provide proper plate-to-plate contact when forming the plate tubes as well as proper fin height spacing between adjacent pairs of plate tubes.

20 Claims, 3 Drawing Sheets

AUTOMOTIVE HEAT EXCHANGER

BACKGROUND OF THE INVENTION

Field of the Invention

The present invention relates generally to a heat exchanger for an automotive vehicle. More particularly, the present invention relates to a heat exchanger having a plurality of contiguous plates which are joined by tab members and folded together to form a plate-tube type heat exchanger.

Disclosure Information

Plate-tube type heat exchangers are well known in the art. In these types of heat exchangers, a plurality of elongated plates are joined together, such as through a lamination process to define a plurality of passageways for the movement of a fluid therethrough. Each of the passageways is formed by the inwardly facing surfaces of a pair of joined plates. The interior surfaces of the joined plates generally define a central fluid conducting section. The passageways are interconnected so that a fluid may flow through the plurality of joined plates forming the heat exchanger. As is also known in the art, conductive fin strips are located between outwardly facing surfaces of the pairs of joined plates. Heat exchangers of this type have particular utility as evaporators for air conditioning systems of motor vehicles.

Typically, plate-tube heat exchangers are manufactured by stacking a plurality of individual plates together to form a plate tube member and interleaving fin members between each tube member. Endsheets are then placed on opposite ends of the heat exchanger to form a heat exchanger core and the core is brazed in a furnace to complete the manufacturing process. Assembling the heat exchanger core in this manner is a labor intensive process requiring personnel to physically place individual plates in abutting face-to-face relationship to form the plate tube member.

One proposed method which may increase the productivity in fabricating plate-tube heat exchangers is shown in U.S. Pat. Nos. 3,258,832 and 3,344,925. These patents disclose a method of making a heat exchanger wherein a plurality of individual plates are stamped from a single sheet of material and interlinked together by tab members. The tab member is a straight piece of metal material which connects the plates and provides a location for bending to occur. After being formed, the plates are folded in a zig-zag formation to form a heat exchanger core. The tab member, however, bends at an undetermined location and cannot provide the most beneficial spacing for a fin member to be included between adjacent pairs of plate tubes and at the same time provide proper plate-to-plate contact.

U.S. Pat. No. 5,507,388, assigned to the assignee of the present invention, proposes a solution to prior methods of joining plates together. The '388 patent teaches an innovative tab design which connects adjacent plates together and which provides predefined bending zones for controlled folding of the plates. Each tab member of the plurality used in the assembly taught in the '388 patent is identical in that each tab member teaches the use of at least three arcuate recesses formed on the leading and trailing edges of the tabs. These recesses form three bending zones in each tab. One central bending zone operates to join plate members together in a face-to-face relationship while the other two zones bend to bring tube members together while providing space for the corrugated fin. After the plates have been folded, these tabs project outwardly from the heat exchanger because of the transverse length required in each tab to provide three bending zones. The projecting tabs prevent the heat exchangers from being stacked together during shipping and often interfere with the heat exchanger housing during packaging. It is necessary to subject the heat exchanger to an additional manufacturing step wherein these projecting tabs are folded in some manner against the heat exchanger to minimize the projection distance.

Furthermore, because each tab member includes three bending zones, more material must be used for each tab. While the use of identical tabs minimizes complexity of the design, using identical tabs each having three bending zones increases the weight and cost of the heat exchanger. It would be advantageous to provide a heat exchanger in which the tab projection is minimized and in which cost and weight are decreased.

It is an object of the present invention to provide a heat exchanger formed from a plurality of contiguous plate members joined by tab members and which is not subjected to a tab folding operation after the heat exchanger has been formed. It is a further object of the present invention to provide a heat exchanger core in which the weight has been reduced.

SUMMARY OF THE INVENTION

The present invention overcomes the above problems with the prior art by providing a heat exchanger for an air conditioning system, comprising a plurality of contiguous plate members joined together by a first and second set of tab members and folded bellows-like into a plurality of tube members to form a heat exchanger core. The heat exchanger further includes a plurality of fin members interposed between adjacent tube members and at least one fluid manifold fluidly connecting the tube members to a source of fluid. The first and second sets of tab members are disposed between adjacent plates in an alternating pattern such that the first set is disposed between a first pair of adjacent plates and the second set is disposed between one of the plates of the first pair and its next adjacent plate. Each tab member of the first set includes a single bend zone along which the adjacent plate members bend in a face-to-face relationship to form a tube member. Each tab member of the second set includes only a first and second bend zones defining an area of predetermined size for receiving one of the plurality of fin members thereinto.

It is an advantage of the present invention to provide two different tab designs which allows for controlled bending of the plurality of the plates and minimizes the distance the tabs project from the heat exchanger after forming. These and other objects, features and advantages of the present invention will become apparent from the drawings, detailed description and claims which follow.

DETAILED DESCRIPTION OF THE PREFERRED EMBODIMENTS

Figure 1:
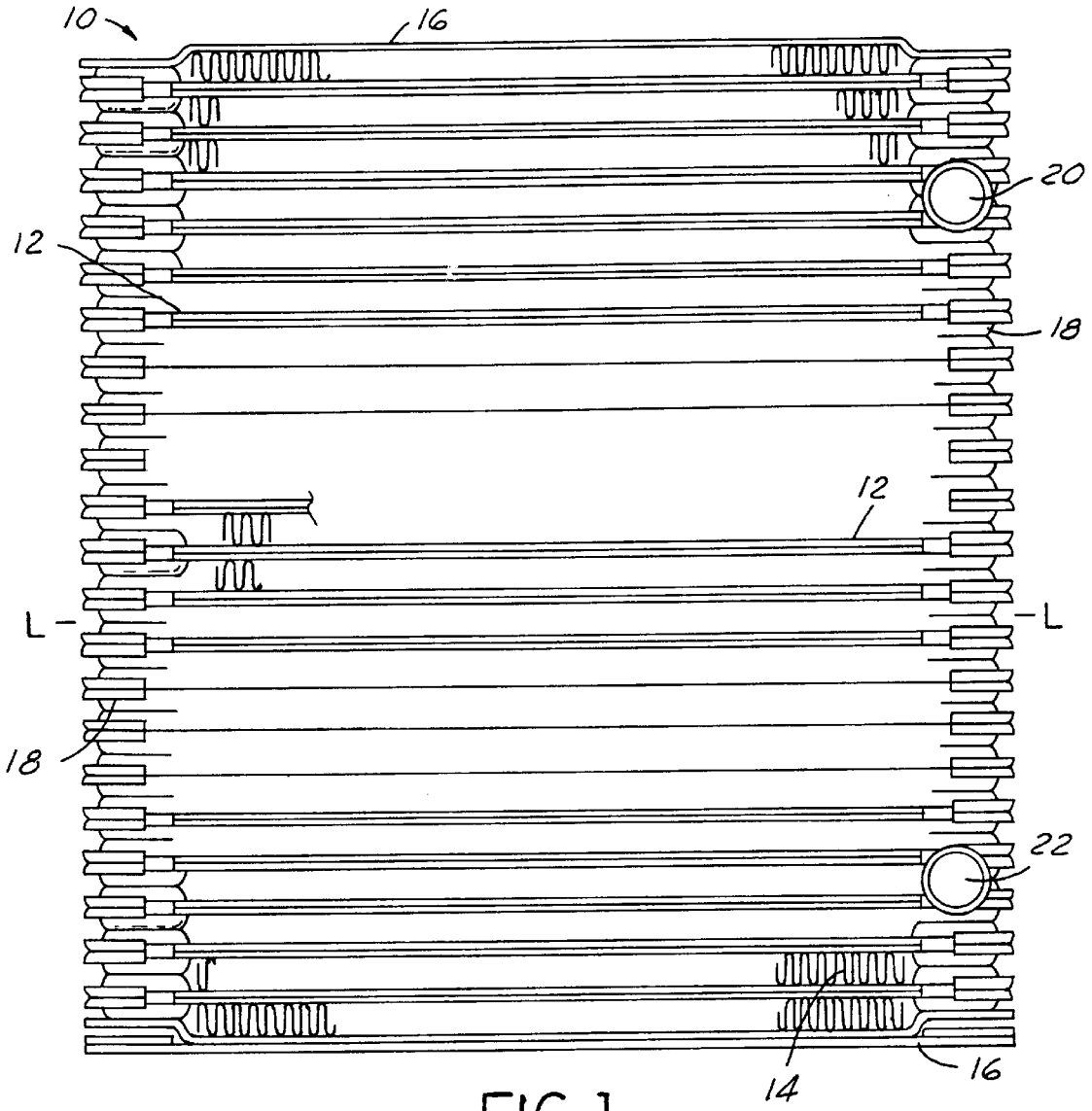
FIG. 1 is a perspective view of a heat exchanger structured in accord with the principles of the present invention.

Referring now to the drawings, FIG. 1 shows a plate-tube heat exchanger, generally designated by the numeral 10, in the form of an evaporator particularly adapted for use in an automobile air conditioning system. The heat exchanger 10 comprises a stack of formed, elongated plates 12, pairs of which are joined together in face-to-face relationship so that adjacent pairs provide alternate passageways for the flow of refrigerant therebetween as will be described further below. The plates may be joined in any of a variety of known processes, such as through brazing or a lamination process. Heat transfer fins 14 are positioned between joined pairs of plates 12 to provide increased heat transfer area as is well known in the art. The joined plate pairs and fin assemblies are contained within endsheets 16.

Figure 2:
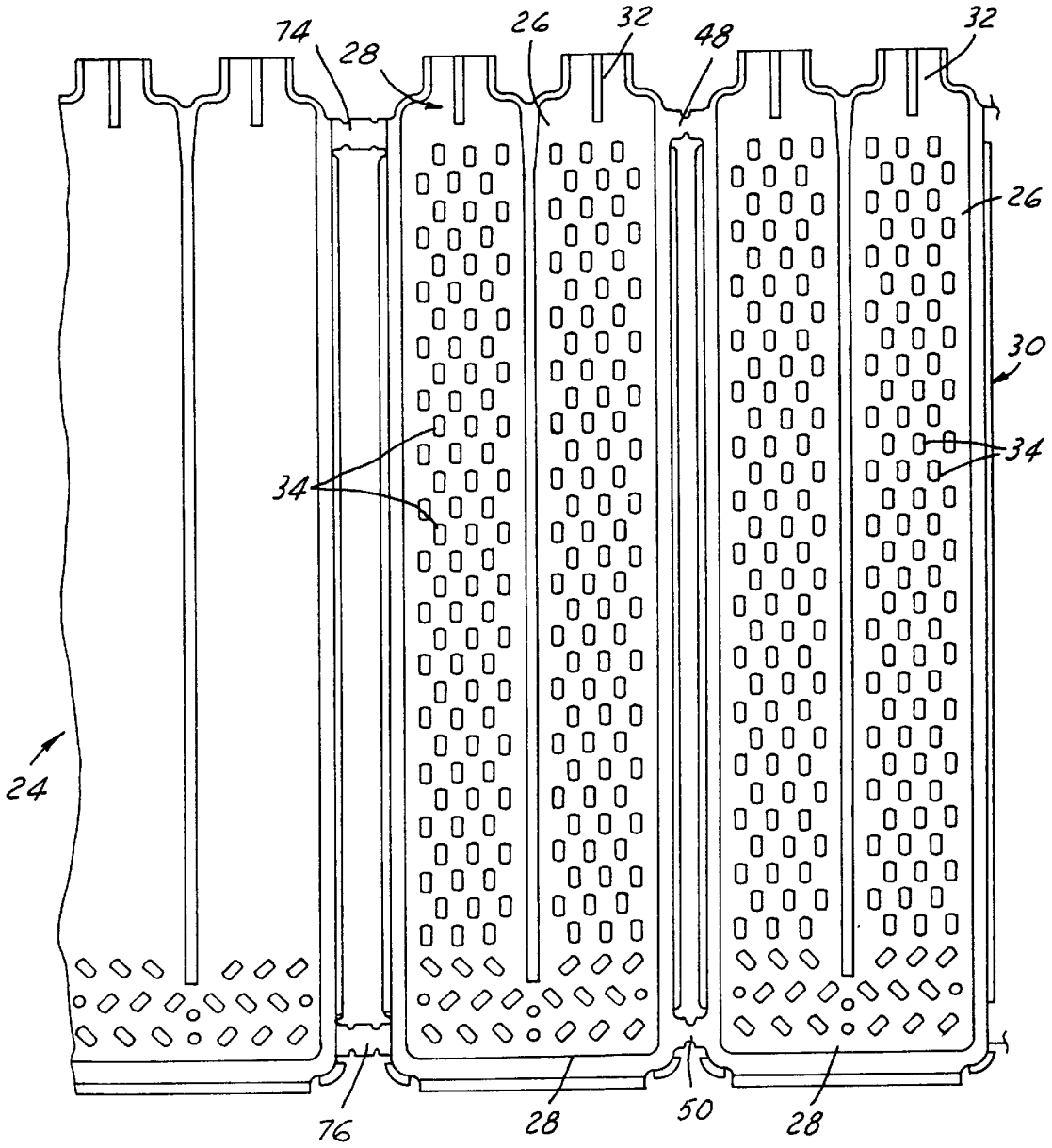
FIG. 2 is a plan view of a continuous sheet of plate members manufactured according to a method of the present invention.

The heat exchanger 10 includes an inlet port 20 and an outlet port 22 formed within a header 18 at either one or both ends of the heat exchanger 10. The header is in direct communication with the passageways between the joined pairs of plates 12 as will become apparent from the following description. The plates 12 have aligned apertures at the ends thereof providing communication between inlet and outlet ports 20, 22, respectively, of header 18. However, as is well known in the art, each of the plates can include apertures at either one or both ends thereof and the inlet and outlet ports 20, 22 can be located at opposite ends of the heat exchanger. Alternatively, as shown in FIG. 2, the plates can be formed with elongated ends which, when mated to adjacent plates, form tubular members. These tubular members are then inserted through a header plate to be in fluid communication with the heat exchanger manifold. In the heat exchanger FIG. 1, refrigerant is directed into the inlet port 20, passed through the pair plurality of joined plates 12 in a known manner. The refrigerant then exits through outlet ports 22 to complete the cooling cycle.

As shown in FIG. 2, the plate members 26 are formed from a single sheet of material 24 and are interconnected by deformable tabs which will be described in greater detail below. The material 24 can be an aluminum material coated with an aluminum brazing alloy as is known in the art. A sheet of material 24 can either be of a predetermined length with a predetermined number of plate members 26 therein or may be formed as a continuous strip of material which is cut at a predetermined number of plates to form a heat exchanger of predetermined size. The plate members 26 are stamped using pneumatic and/or hydraulic activated details in a die controlled by a PLC\PLS or other computerized means known in the die pressing art.

Each of the plate members 26 includes a pair of end portions 28 and an intermediate portion 30 therebetween. An elongated end 32 extends from one end of the plate. In one embodiment, this end 32 is configured to extend through a header plate and into a tank (not shown) of a fluid manifold. Alternatively, as shown in U.S. Pat. No. 5,707,388, the disclosure of which is hereby incorporated by reference, a plurality of apertures can be formed in each of the end portions 28 or alternatively, a single aperture can be formed therein. The apertures are aligned when the heat exchanger is assembled to provide for a fluid conduit for the heat exchanger fluid to pass therethrough. Each of the intermediate portions 30 of the plate members 26 includes a plurality of beads 34 which, as is well known in the art, provide a circuitous path for the fluid to pass through the plate tube 12 to increase the turbulence of the fluid and provide for better heat transfer characteristics.

Figure 3:
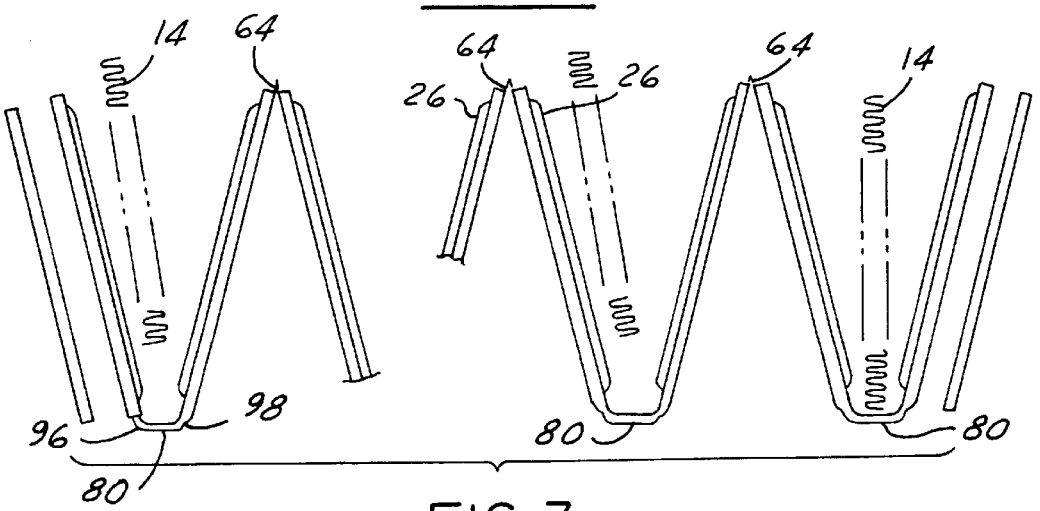
FIG. 3 is an end view of the sheet of FIG. 2 being folded into plate tube members.

FIG. 3 illustrates that the heat exchanger of the present invention is formed by folding the sheet of material 24 in a bellow-like or accordion-like fashion. When folded, adjacent plate members matingly engage to form the plate tubular members as will be described in greater detail below. The material is folded at the tabs joining adjacent plate members as will be described.

Figure 4A:
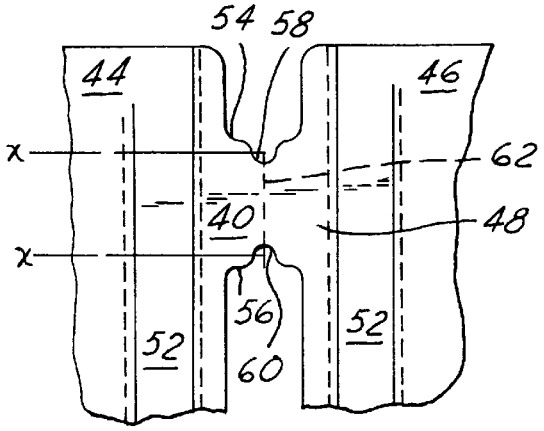
FIGS. 4A and B are enlarged views of a first set of tab members connecting adjacent plates in accordance with the present invention.
Figure 4B:
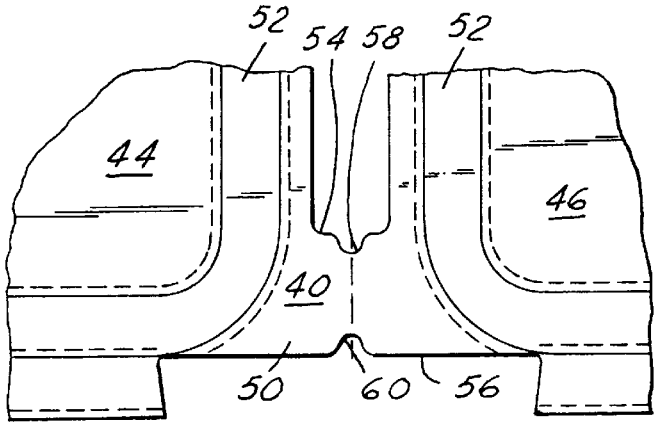
Figure 5A:
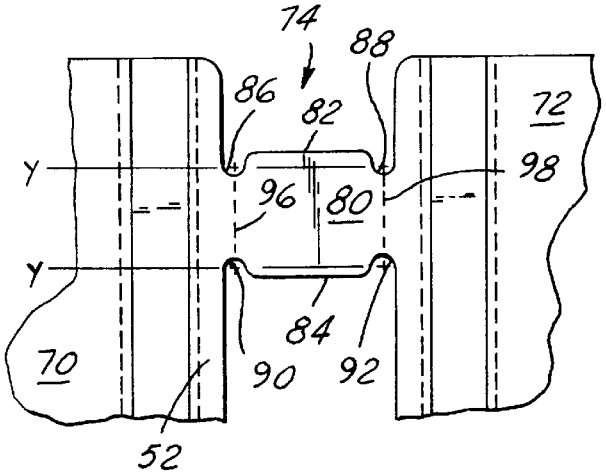
FIGS. 5A and B are enlarged views of a second set of tab members connecting adjacent tubes together in accordance with the present invention.
Figure 5B:
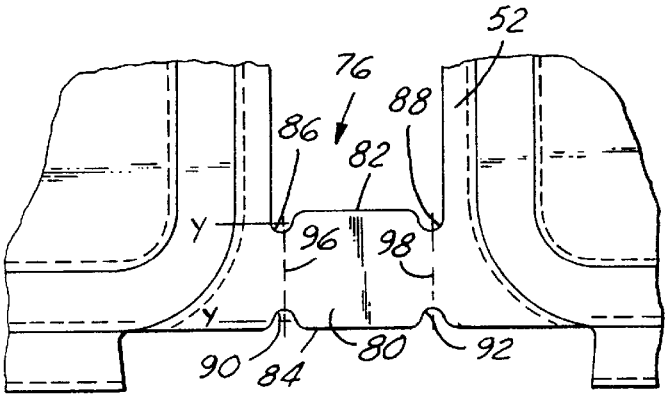

FIGS. 4 and 5 show details of the first set and second set of deformable tabs connecting the plates 28 together. As shown in FIGS. 4A and B, each first set of tab members connects adjacent plates 44, 46 and each set includes two tab members, an upper tab 48 and a lower tab 50. The tabs 48, 50 extend transversely from one plate to another and are formed as part of the rail edge 52 of each plate 44, 46. The tabs 48, 50 are made from the same material as the plates and are plastically deformable. Each tab includes a web section 40 disposed generally parallel to the transverse axis of the plates and includes a first edge 54 and a second edge 56. The first edge 54 includes a single, central, medial recess 58. In the preferred embodiment of the tab, this recess 58 is generally arcuate, having a radius of curvature of approximately 0.0300 inches. The present invention contemplates that other shaped recesses may work equally as well, such as triangled-shaped recess, or arcuate recesses having different sized radii of curvature.

Similarly, the second edge 56 of web 40 includes a generally centrally disposed medial recess 60. The second recess 60 is also generally arcuate in shape and are generally disposed opposite the first distal recess 58. In the preferred embodiment of the tab, this recess 60 is generally arcuate, having a radius of curvature of approximately 0.0300 inches. The present invention contemplates that other shaped recesses may work equally as well, such as triangled-shaped recess, or arcuate recesses having different sized radii of curvature.

As shown in FIGS. 4A and B, the distance, x—x, between the first and second medial recesses 50, 60 defines a single bend zone 62. The single bend zone 62 allows for much more narrow bending to accomplish good plate-to-plate contact during the forming of the heat exchanger core by the bellows-like or zig-zag folding of the contiguous plate members. By using a tab having only a single bend zone, the transverse length of the tab can be decreased. This provides the advantage shown in FIG. 3 wherein the folded tab 64 projects very little from the folded plate assembly, thus obviating the need for an additional tab bending process.

FIGS. 5 A and B show the details of the second set of tab members. As shown therein, each second set of tab members connects adjacent plates 70, 72 and each set includes two tab members, an upper tab 74 and a lower tab 76. The tabs 74, 76 extend transversely from one plate to another and are formed as part of the rail edge 52 of each plate 70, 72. The tabs 74, 76 are made from the same material as the plates and are plastically deformable. Each tab includes a web section 80 disposed generally parallel to the transverse axis of the plates and includes a first edge 82 and a second edge 84. The first edge 82 includes a first pair of distal recesses 86, 88 which are generally arcuate, having a radius of curvature of approximately 0.0300 inches. The present invention contemplates that other shaped recesses may work equally as well, such as triangled-shaped recess, or arcuate recesses having different sized radii of curvature. Similarly, the second edge 84 of web 80 includes a second pair of distal recesses 90, 92 which are generally arcuate in shape and are generally disposed opposite the first pair of distal recesses 86, 88. The present invention contemplates that other shaped recesses may work equally as well, such as triangled-shaped recess, or arcuate recesses having different sized radii of curvature.

As shown in FIG. 5, the distance, y—y, between the recesses on the first edge 82 and those on the second edge 84 defines only a first bend zone 96 and a second bend zone 98. The first bend zone 96 and second bend zone 98 provide a location at which the web 80 bends during the folding of the plates in forming the core to allow for fin insertion between adjacent plate tubes. The distance between these two bend zones is approximately equal to the fin height. By eliminating a third bend zone, the transverse length of the tabs can be minimized, reducing the amount of material needed to fabricate the tabs and reducing the distance a folded tab projects from the heat exchanger core. Furthermore, it was necessary in the tabs of the '388 patent to vary the thickness of the tabs to ensure proper bending between the different bend zones. By providing tabs as described above, the material thickness can be held constant, reducing complexity of the design.

To manufacture an evaporator according to a method of the present invention, the plate members 26 and tab sets are stamped from the sheet of material 24. As shown in FIG. 2, two plates can be stamped in a single stroke of the die. The plate members 26 are then bent at the bend zones 62, 96, 98 in the tab sets into folds such as shown in FIG. 3 so that adjacent plate members 26 are in abutting, face-to-face relationship to form a plate tube member 12 and that sufficient space remains between adjacent plate tubes remains for fin insertion. After the plate members 26 have been folded a predetermined amount, the fin members 14 are inserted between outwardly facing surfaces of the pairs of the plate members 26, either manually or automatically. After the fin members have been inserted, endsheets 16 are added at opposite ends of the plate tube\fin assembly to complete the heat exchanger core and the core is compressed under a predetermined load. The core is then placed into a brazing furnace and passed through a vacuum brazing operation in which the metal brazes together in order to form the completed article.

Various modifications and alterations of the present invention will, no doubt, occur to those skilled in the art to which this invention pertains. For example, the present invention has been described with reference to tab members joining plates along longitudinal axes. The present invention also contemplates that the plates may be joined along the transverse axis as well, using the tab members of the present invention. These and all other variations which rely upon the teachings by which this disclosure has advanced the art are properly considered within the scope of this invention as defined by the appended claims.

What is claimed is:

1. A heat exchanger for an air conditioning system, comprising:

a plurality of generally planar, interconnected plate members folded in a bellows-like manner to form a plurality of tube members through which a fluid can flow;

a plurality of corrugated fin members interposed between adjacent tube members;

a first set of tab members interconnecting adjacent plate members, each tab member of said first set including a single bend zone along which said adjacent plate members bend in a face-to-face relationship to form a tube member; and a second set of tab members distinctly shaped with respect to said first set of tab members interconnecting adjacent tube members, each tab member of said second set including a first and second bend zones defining an area of predetermined size for receiving one of said plurality of fin members thereinto.

2. A heat exchanger according to claim 1, wherein said first set of tab members includes a pair of tabs disposed between adjacent plate members.

3. A heat exchanger according to claim 2, wherein each tab member of said first set of tab members includes a first edge including a single recess disposed at a predetermined location thereof and a second edge having a single recess disposed opposite said recess along said first edge.

4. A heat exchanger according to claim 3, wherein said recesses along said first edge and second edge of said tab members are generally arcuate.

5. A heat exchanger according to claim 3, wherein said first edge of said tab member includes a single medial, generally arcuate recess and said second edge of said tab member includes a single second medial recess disposed opposite said first medial recess by a predetermined distance.

6. A heat exchanger according to claim 5, wherein said single bend zone is formed between said medial recesses disposed on said first and second edges of said tab member.

7. A heat exchanger according to claim 1, wherein said second set of tab members includes a pair of tabs disposed between adjacent tube members.

8. A heat exchanger according to claim 7, wherein each tab member of said second set of tab members includes a first edge including a pair of recesses disposed at a predetermined location thereof and a second edge having a pair of recesses disposed opposite said recesses along said first edge.

9. A heat exchanger according to claim 8, wherein said recesses are generally arcuate-shaped.

10. A heat exchanger according to claim 8, wherein said first and second bend zones of said second set of tab members are formed between said recesses disposed on said first and second edges of said tab member.

11. A heat exchanger according to claim 1, wherein said plate members include a longitudinal axis and a transverse axis, the longitudinal axis being generally parallel to the flow of fluid over said plate member, and wherein each tab of said first and second sets of tab members is disposed generally parallel to the transverse axis of the plate members, with the transverse distance of said first set of tab members being less than the transverse distance of said second set of tab members.

12. A heat exchanger according to claim 1, wherein two adjacent plate members are formed in a single stroke of a material stamping die.

13. An evaporator for an air conditioning system, comprising:

a plurality of contiguous plate members joined together by a first and second set of distinctly shaped tab members and folded bellows-like into a plurality of tube members to form an evaporator core;

a plurality of fin members interposed between adjacent tube members;

said first and second sets of tab members being disposed between adjacent plates in an alternating pattern such that said first set is disposed between a first pair of adjacent plates and said second set is disposed between one of the plates of said first pair and its next adjacent plate.

14. An evaporator according to claim 13, wherein each tab member of said first set includes a single bend zone along which said adjacent plate members bend in a face-to-face relationship to form a tube member and each tab member of said second set includes only a first and second bend zones defining an area of predetermined size for receiving one of said plurality of fin members thereinto.

15. An evaporator according to claim 14, wherein each tab member of said first set of tab members includes a first edge including a single medial, generally arcuate recess disposed at a predetermined location thereof and a second edge having a single, medial, generally arcuate recess disposed opposite said recess along said first edge by a predetermined distance.

16. An evaporator according to claim 15, wherein said single bend zone is formed between said medial recesses disposed on said first and second edges of said tab member.

17. A heat exchanger according to claim 13, wherein each tab member of said second set of tab members includes a first edge including a pair of spaced, arcuate recesses disposed at a predetermined location thereof and a second edge having a pair of spaced, arcuate recesses disposed opposite said spaced recesses along said first edge.

18. An evaporator according to claim 17, wherein said first and second bend zones of said second set of tab members are formed between said spaced recesses disposed on said first and second edges of said tab member.

19. An evaporator according to claim 13, wherein two adjacent plate members are formed in a single stroke of a material stamping die.

20. An evaporator for use in an air conditioning system of an automotive vehicle, comprising:

a plurality of generally planar, interconnected plate members having a longitudinal axis generally parallel to the flow of fluid over the plate members, the plate members being folded in a bellows-like manner to form a plurality of tube members through which a fluid can flow;

a plurality of corrugated fin members interposed between adjacent tube members;

a first set of tab members interconnecting adjacent plate members, each tab member of said first set including a single bend zone along which said adjacent plate members bend in a face-to-face relationship to form a tube member, each tab member of said first set of tab members further including a first edge including a single medial recess disposed at a predetermined location thereof and a second edge having a single medial recess disposed opposite said recess along said first edge such that said first bend zone is formed between said medial recesses; and a second set of tab members distinctly shaped with respect to said first set of tab members interconnecting adjacent tube members, each tab member of said second set including a first and second bend zones defining an area of predetermined size for receiving one of said plurality of fin members thereinto, each tab member of said second set of tab members further including a first edge including a pair of spaced recesses disposed at a predetermined location thereof and a second edge having a pair of spaced recesses disposed opposite said recesses along said first edge such that said first and second bend zones are formed between said spaced recesses in a direction generally parallel to the longitudinal axis of said plate members, the transverse length of each tab member of said second set being greater than the transverse length of each tab of said first set of tab members.

* * * * *